United States Patent [19]

Arnold et al.

[11] Patent Number: 4,810,984

[45] Date of Patent: Mar. 7, 1989

[54] DIELECTRIC RESONATOR ELECTROMAGNETIC WAVE FILTER

[75] Inventors: Pitt W. Arnold, Phoenix; Kevin M. Gaukel, Tempe, both of Ariz.

[73] Assignee: Celwave Systems Inc., Phoenix, Ariz.

[21] Appl. No.: 93,232

[22] Filed: Sep. 4, 1987

[51] Int. Cl.[4] ..... H01P 1/201; H01P 7/10

[52] U.S. Cl. ..... 333/202; 333/219.1; 333/234; 333/235

[58] Field of Search ..... 333/235, 234, 232, 229, 333/219.1, 202

[56] References Cited

U.S. PATENT DOCUMENTS

| | | | |
|---|---|---|---|
| 2,716,222 | 8/1955 | Smullin | 333/229 |
| 3,311,839 | 3/1967 | Rutulis | 333/232 X |
| 4,050,040 | 9/1977 | Fincke et al. | 333/206 |
| 4,241,322 | 12/1980 | Johnson et al. | 333/202 |
| 4,423,397 | 12/1983 | Nishikawa et al. | 333/202 X |
| 4,524,481 | 6/1985 | Kivi | 333/234 |
| 4,613,838 | 9/1986 | Wada et al. | 333/235 X |
| 4,639,699 | 1/1987 | Nishikawa et al. | 333/235 X |
| 4,646,038 | 2/1987 | Wanat | 333/202 |
| 4,661,790 | 4/1987 | Gannon et al. | 333/235 X |
| 4,667,172 | 5/1987 | Longshore et al. | 333/134 |

FOREIGN PATENT DOCUMENTS

| | | | |
|---|---|---|---|
| 1052484 | 3/1959 | Fed. Rep. of Germany | 333/222 |
| 167202 | 7/1986 | Japan | 333/234 |
| 288501 | 12/1986 | Japan | 333/234 |
| 216809 | 7/1968 | U.S.S.R. | 333/224 |

*Primary Examiner*—Eugene R. LaRoche
*Assistant Examiner*—Benny T. Lee
*Attorney, Agent, or Firm*—Kenneth R. Bowers, Jr.

[57] ABSTRACT

A dielectric resonance electromagnetic filter for selection of a resonance frequency of a high frequency electromagnetic wave having the dielectric resonator attached directly to the shield. The filter is tunable using a tuning cylinder which moves through a cavity in the center of the resonator.

The tuning cylinder is hollow and is designed to expand thermally during heatup to counter thermal changes in the resonance frequency. The tuning cylinder may be metal or dielectric material or may have sections of both materials.

A shield geometry has been described which enables filter clusters to occupy a minimum volume.

4 Claims, 2 Drawing Sheets

DIELECTRIC RESONATOR ELECTROMAGNETIC WAVE FILTER

BACKGROUND

1. Field of the Invention

This invention relates to electromagnetic wave cavity filters having a dielectric resonator, and to combinations of such filters within a common shield.

2. Prior Art

An electromagnetic resonator is a device which allows one electromagnetic frequency to pass through it while rejecting all other frequencies. Such resonators are common elements in communications systems. In the UHF and microwave region, or the frequencies above 300 megahertz, the resonators required to give adequate frequency selectivity and power transmission take the form of hollow metallic cylinders. These resonators can occupy a large volume if high selectivity and low losses are required. In general, a higher degree of selectivity requires a larger resonator, possessing a higher Q factor. The Q factor, defined as the ratio of the energy stored in the resonator to that dissipated per frequency cycle, is the common measure of a resonator's performance. In complex systems, the volume occupied by a resonator of desired Q factor is excessive. For example, a transmitter system operating at 900 MHz which combines 16 transmitters into one antenna requiring Q values of 15,000 requires 300 cubic inches of space per channel for the resonators.

The use of a dielectric material having a high dielectric constant such as barium titanate enables reduction of the volume of the resonator by a factor of fifty with the same Q factor.

A dielectric resonator must be enclosed in an enclosure to reduce coupling to other resonators and to the outside environment. This aspect of resonator design is described in U.S. Pat. No. 4,241,322 issued Dec. 23, 1980 to Johnson et al. which is also generally descriptive of the prior art relating to this invention. All reference numerals recited in the remainder of this Prior Art section relate to Johnson et al.

Dielectric resonators are usually tunable within a band of frequencies. The exact frequency at which resonance occurs can be operator selected by rotation of a screw which raises and lowers the position of a flat plate held above the dielectric. Refer to Johnson et al. A dielectric resonator 11 is held by epoxy to a substrate 12, composed of a material which has low heat conductivity. (Col. 3, L45–50) A tuning plate 41 moves toward or away from dielectric resonator 11 to tune the response of the resonator. (Col. 4, L40–42).

During operation of the resonator, electromagnetic energy at input terminal 30 or 55 which oscillates at the resonance frequency will appear at output terminal 30 or 35. Electromagnetic energy which oscillates at other frequencies will be discriminated against by reflection within the resonant structure. Dielectric resonator 11 is cooled by conduction and convection in the air within the shield formed by housing 21,22. During temperature transients, heatup and cooldown, the Q factor may vary as may the resonance frequency.

Multiple filters, tuned to seperate resonance frequencies, may be grouped togather in a common assembly to facilitate connection to a common antenna. Johnson et al. illustrates a typical grouping.

It is an object of this invention to improve the heat transfer of a dielectric resonating filter.

It is a further object of this invention to improve the temperature stability of the resonance frequency of a dielectric filter.

It is a further object to facilitate grouping of multiple filters.

SUMMARY OF THE INVENTION

The invention is a dielectric resonance filter having the dielectric resonator, shaped as a cylinder, secured directly to the shield. The dielectric resonator is therefore in physical contact with the shield and is therefore cooled by conduction across the junction. The improved cooling results in lower temperature steady state operation of the dielectric resonator and improved stability of the quality factor Q.

Direct affixation of the dielectric resonator to the shield leaves no space between the shield and the dielectric resonator for a flat tuning plate. The invention preserves the tunable feature by a movable tuning cylinder which traverses up and down a cylindrical cavity through the dielectric resonator along its axis. The tuning cylinder is composed of metal or dielectric material along the length insertable into the dielectric resonator.

Dielectric resonator-to-shield contact and insertion of the tuning cylinder into the dielectric resonator both enhance heat transfer between the tuning cylinder and the dielectric resonator. Heat induced expansion of the tuning cylinder has been adapted to counteract the effects of a temperature rise in the dielectric resonator. The tuning cylinder increases in length due to a temperature rise, which extends the tuning cylinder into the dielectric resonator an additional length which is a function of the coefficient of thermal expansion of the metal material, of the temperature rise, and of the length of the tuning cylinder at ambient temperature. The physical length and thermal coefficient of expansion of the metallic tower which supports and contains the tuning cylinder is equally important. A wise choice of these parameters enables the resonator to automatically maintain a constant resonance frequency during reasonably expected temperature transients without mechanical tuning.

The aforementioned metallic tower is mounted on an outside surface of the shield to support and control the tuning cylinder, is defined herein as a compensation tower (7 in FIG. 1), and has also been utilized as a trap to eliminate at least one spurious resonance frequency. Aperture 28 through shield 2 allows electromagnetic communication or current flow between the interior of tower 7 and resonator 1.

The elimination of a flat tuning plate and substitution of an insertable tuning cylinder facilitates use of a shield which is not circular or elliptical in cross section. Since the shield need not contain a circular tuning plate or accommodate the cylindrical volume swept through by movement of such a plate, the shield can be more easily be formed into a wedge which in a cluster of filters, mates together to occupy a minimum volume. One surface of the shield, when in juxtaposition with abutting shields of other filters, forms the curved surface of a cylinder. Two other surfaces of the shield meet at an angle defined by 360 degrees divided by "N" where N is the number of desired filters in the cluster.

DETAILED DESCRIPTION

Figure 1:
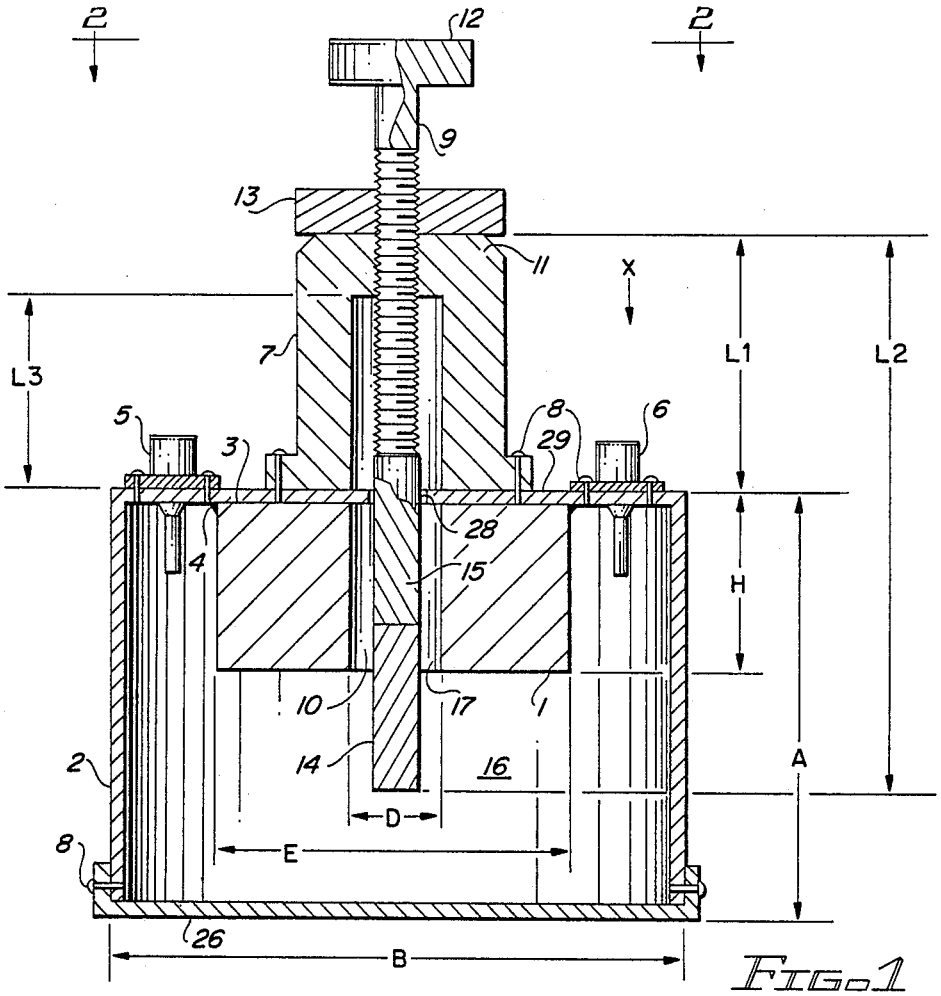
FIG. 1 is a schematic profile of a cylindrically shielded filter.

This invention contemplates substantial improvements to dielectric resonator electromagnetic filters which are, except for the new features as described herein, well known in the art of radio, radar, and communications design. To the extent necessary, construction details not considered routine engineering may be derived from U.S. Pat. No. 4,241,322, "Compact Microwave Filter with Dielectric Resonator", issued Dec. 23, 1980 to Johnson et al., incorporated herein by reference. All reference numerals recited in the remainder of this paragraph relate to Johnson et al.

Refer to FIG. 1 of the Johnson et al. reference. A dielectric resonator 11 is attached by epoxy to a substrate 12 (Col. 3 L45–49). In practice, substrate 12 is a disc of low thermal conductivity material such as alumina or any ceramic. The frequency of resonance of resonator 11 is tunable by tuner assembly 40 which comprises a tuning plate 41, a shaft 42, and a knob 43. During operation, heat deposited in resonator 11 is removed by air conduction and convection inside the cavity formed by closure of housing 21,22. By inspection of FIGS. 1 and 2 of the Johnson et al reference, it can be seen that substrate 12 is captured by a recess in housing 21 at the junction of housing 21,22 and resonator 11 is suspended in air without physical contact with housing 21,22 which is the shield. Consequently, little or no heat conduction cooling through the circular upper surface of resonator 11 occurs.

Refer to FIG. 1. An electrically conductive metal shield 2 which resembles a metal container houses a dielectric resonator 1. Two electrodes 5,6 penetrate shield 2 and are used as input and output connections to deliver high frequency electrical energy to the filter. Details of electrodes 5,6 can be obtained by inspection of terminal members 30,35 of the reference. Shield 2 has a removable cover, 26, held by screws 8.

Dielectric resonator 1 is a cylinder of dielectric material. Resonator 1 is not attached to a ceramic disc as is resonator 11 in the Johnson et al. reference but rather is attached directly to an inner surface of metal shield 2 which surrounds and encloses resonator 1. In FIG. 1, the junction between resonator 1 and shield 2 is labeled surface 3.

In a preferred embodiment, resonator 1 is electroplated with copper on the circular face of its cylindrical geometry and it is this copper clad face which is attached to the shield at surface 3. The resonator 1 can be soldered at junction 4 to shield 2. Shield 2 is composed of heavy gauge copper. Alternatively, resonator 1 can be attached to shield 2 by screws, epoxy, or other means.

Dielectric resonator 1 is in excellent thermal contact with shield 2 over a wide area. Thermal energy deposited in resonator 1 is conducted through surface 3 into shield 2 through copper which has relatively high thermal conductivity as compared to the ceramic materials used to form substrate 12 of the reference, and consequently resonator 1 operates at a lower temperature. In practice, as an illustration, it has been found that, with 20 watts dissipated in a resonator of the prior art, the resonator surface temperature exceeds the shield temperature by 50 degrees F. The inventive shield mounted resonator, with 20 watts dissipated therein, has a temperature gradient of only 15 degrees F between its upper and lower surfaces, its upper surface temperature being that of the external can surface.

The quality factor Q of the filter declines with shield mounting as compared to a substrate support mounting as measured during a startup at ambient temperature by about 25%. This is due to geometric non-symmetry. However, the quality factor Q is inversely proportional to the absolute temperature of the resonator 1, and in steady state operating conditions the lower temperature of operation of a shield mounted resonator 1 results in less reduction of the Q factor.

Attachment of resonator 1 to shield 2 eliminates the volume between resonator 1 and shield 2 which in the Johnson et al reference is occupied by tuner assembly 40. A new technique for tuning the filter is mandated by shield mounting. In FIG. 1, a cylindrical compensation tower 7 has been attached by screws 8 to an outside, top surface 29 of shield 2. Tower 7 supports a tuning plunger 9 which is insertable into and removable from, through an aperture 28 in shield 2, a cavity/aperture 10 in the body of resonator 1, to alter the electromagnetic field of resonator 1. A portion of plunger 9 may be threaded as is an opening 11 in tower 7. Rotation of a knob 12 impels rotation of plunger 9 through threaded opening 11 in tower 7, causing plunger 9 to move linearly either into or out of resonator 1 as determined by the direction of rotation. A chosen position of plunger 9 may be secured by a locknut 13 threaded on plunger 9 and abutting tower 7.

In the preferred embodiment, the portion of plunger 9 which traverses cavity 10 is composed of a dielectric material, especially the material of which resonator 1 is composed. Insertion of plunger 9 into cavity 10 "adds dielectric" to resonator 1 which shifts the resonance frequency of the filter downward to a lower frequency.

In a second embodiment, tuning plunger 9 is composed of metal. Insertion of plunger 9 into cavity 10 "adds metal" to resonator 1 which shifts the filter resonance upward in frequency. This embodiment is less preferred since the Q factor is reduced by 20%. This Q reduction occurs with the tuning scheme of the Johnson et al reference also..

In FIG. 1, an endmost portion 14 and an adjacent portion 15 are defined as sections along the length of plunger 9 which can enter cavity 10. While both of these sections may be metal or both may be dielectric material as described in the above embodiments, in a third embodiment endmost portion 14 is of dielectric material while adjacent portion 15 is of metal. The length of endmost portion portion 14 should be at least equal to H, the height of resonator 1. Plunger 9 can be adjusted to place endmost portion 14 entirely within cavity 10. Movement of plunger 9 into cavity 10 will will begin to remove dielectric and also to add metal as endmost portion 14 enters region 16 which is an empty volume within shield 2.

It is preferred that plunger 9 and cavity 10 will have circular cross section.

For clarity in FIG. 1, plunger 9 and resonator 1 have a large gap 17 therebetween. In practice, gap 17 may be small.

Figure 2:
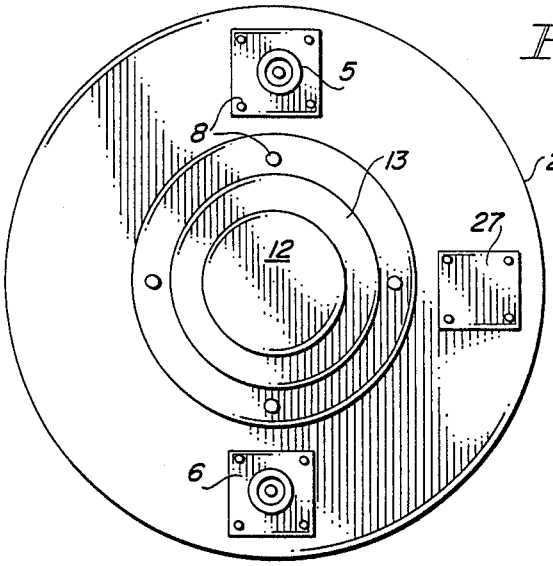
FIG. 2 is an elevation view from FIG. 1.

Refer to FIG. 2 which is an overhead view of the filter of FIG. 1 except that cover 26 is omitted for clarity. Shield 2 supports electrodes 5,6. Location 27 is 90 degrees removed from each electrode 5,6 while electrodes 5,6 are 180 degrees removed from each other. Location 27 is a site at which one of electrodes 5,6 could be installed. Location 27 has a plate which is screwed to shield 2 and which covers and seals a penetration through shield 2 which is needed if an electrode is installed there. To install an electrode at location 27 is a simple matter of moving electrode 5 or 6 to location 27 and installing the plate at the previous location of the electrode. The shield penetrations, plate, screws 8, and screw holes are basis for means for attachment of output terminals in the claims.

A dielectric resonator filter is designed to pass a single frequency and to reject all others in a symmetrical manner; that is, the amount of rejection is equal at equal increments of frequency on either side of the frequency passed. The inventive filter has an asymmetrical rejection characteristic which can be reversed by selecting a 90 or 180 degree relation between electrodes 5 and 6. With electrodes 5,6 ninety degrees removed, the lower frequency rejection is enhanced, while at 180 degrees removal, the upper frequency rejection is enhanced. The filter response can thus be enhanced for a given application by proper terminal location.

For a given temperature variation caused by room temperature changes or by heat dissipated in the resonator, the metallic tuning elements will expand in length by an increment ΔL by the equation:

$$\Delta L = CE \cdot L\ (T2 - TA)$$

where ΔL is the increase in length of plunger 9 during heating from TA to T2, TA is an initial lower temperature, T2 is a higher temperature, CE is the coefficient of linear expansion of the material being considered, and L is the length of the metallic element, in this illustration plunger 9, at TA. The metallic elements of interest are plunger 9 and tower 7. An increase in temperature will cause plunger 9 to increase in length and lower the frequency of resonance, while tower 7 will tend to increase in length tending to withdraw plunger 9 and increase the frequency. By a proper selection of L and CE it is possible to design for a net movement of plunger 9 in either direction or for no net movement. With reasonable dimensions and materials having coefficients ranging from 1 ppm/°F. to 13 ppm/°F. it is possible to vary the frequency change with temperature as much as 2 ppm/°F. or 2 hertz/megahertz/°F. An all metal tuning system would be analo a system having a dielectric plunger portion 14 except that if portion 14 is metal, there is a radial component of thermal expansion which can also shift the resonance frequency.

Figure 3:
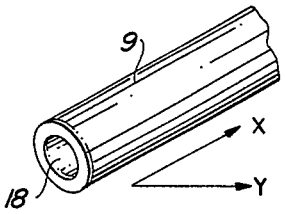
FIG. 3. is a detail from FIG. 1 in perspective.

Refer to FIG. 3. Direction "X" is along the axis of plunger 9 and is also labeled in FIG. 1. "X" is the direction along which linear expansion can be used for temperature stability. Direction "Y" is along the radius of the circular cross section of plunger 9, and is the direction of the radial component of thermal expansion. Plunger 9 is hollow, having a cylindrical hole 18 therethrough along X. Radial dimensional changes along Y in plunger 9 with temperature changes are minimized by hole 18.

Figure 4:
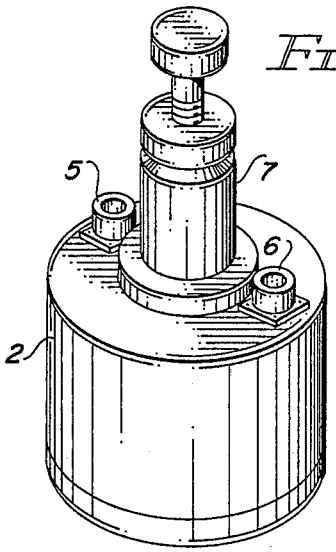
FIG. 4 is a perspective view of a filter having a cylindrical shield.
Figure 5:
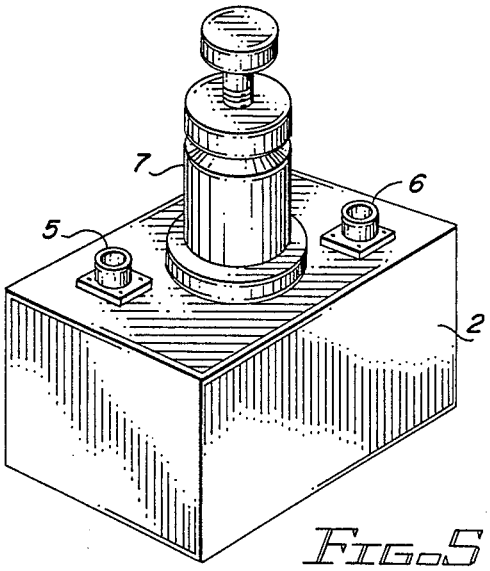
FIG. 5 is a perspective view of a filter having a shield which has the geometry of a square or rectangular box.
Figure 6:
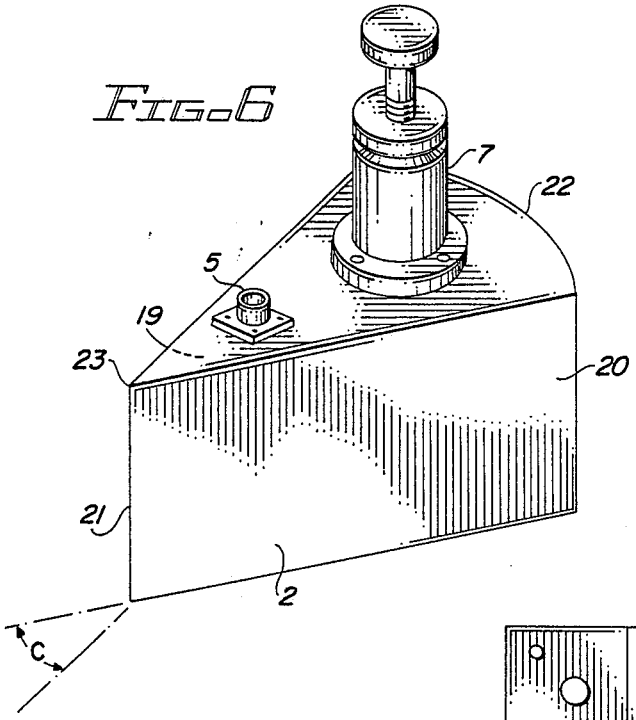
FIG. 6 is a perspective view of a filter having a shield which has the geometry of a wedge.
Figure 7:
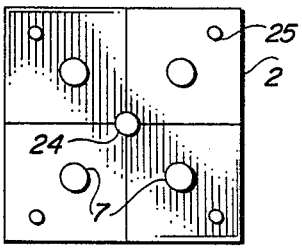
FIG. 7 is a schematic elevation of a cluster of four filters of the type shown in FIG. 5.

Refer to FIGS. 4,5 and 6. These illustrate filters having shields 2 which are respectively, a right circular cylinder, a square cube, and a section of a right circular cylinder. The filter of FIG. 4 is intended for use by itself since its geometry does not cause it to mate with the shape of other filters. The cube shaped shield 2 of FIG. 5 enables such a filter to be used individually or in groups of four as illustrated in FIG. 7. Shield 2 of FIG. 6 has a first face 19, intersecting a second face 20, along an edge 21, with faces 19,20 defining an angle C therebetween. Angle C is chosen to be 360 degrees divided by N, the number of filters which are to be grouped. As examples, C is 72 degrees when, as in FIG. 8, five filters are grouped. C is 90 degrees when, as in FIG. 7, four filters are grouped. C is 60 degrees when six filters are grouped. Edge 22 in FIG. 6 is a segment of a circle centered at point 23. When N filters of the type shown in FIG. 6 are grouped in a cluster, a right circular cylinder is formed which can be contained in a small space.

Figure 8:
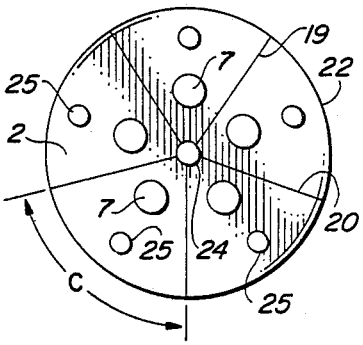
FIG. 8 is a schematic elevation of a cluster of five filters of the type shown in FIG. 6.

Refer to FIGS. 7 and 8. These figures are schematics intended to illustrate how filters may be grouped and do not teach all details of construction. The boundaries between adjacent filters are shown as a single line which may be an upper view of face 20 in FIG. 6. If it is planned to form a cluster in advance, all the shields 2 of the filters in the cluster may be formed as an integral whole and the boundaries between adjacent filters will be a metal wall serving as a shield wall for two adjacent filters. If the cluster is formed by the grouping of N independant filters, each with its own shield 2, then the boundaries between adjacent filters will be double shield walls.

The cluster may be held together by insertion into a container or a variety of means to bind the group may be used.

In FIGS. 7 and 8, each filter has its own input electrode 25 but all filters of the cluster share a common output electrode 24.

When four filters are grouped, either cube shields as per FIG. 5 or wedge shields as per FIG. 6 may be used depending on whether the application suggests a circular or a square cross section for the group.

The length L3 in FIG. 1 of tower 7 can be chosen to form a trap for an undesirable resonance frequency. A trap is defined herein as a resonance volume in series with the resonator 1 in which a wave can resonate without reaching the output terminal. Shield aperture 28 extends between the interior of shield 2 and the interior of tower 7.

Refer to FIG. 1. Typical dimensions for an 880 MHz filter are: A—5.0 inches, B—6.0 inches, D—2.6 inches, E—0.875 inches, H—1.5 inches, L1—3.0 inches, L2—3.5 inches, and L3—2.5 inches.

While in this specification, in the drawings, and in the claims, devices have been described which practice the features now claimed, it should be understood that various modifications can be made to the described devices without departure from the true spirit and scope of the invention. Such modifications should be considered routine engineering rather than invention. For example, advancement of the tuning plunger could be automated by a remotely controlled solenoid. As a further example, the resonator could have a cross section which is not circular and the tuner plunger could also have a non-circular cross section.

We claim:

1. A transverse electric mode dielectric resonating electromagnetic filter for the selection of a discrete frequency of an electromagnetic signal which resonates in a resonator composed of dielectric material, said resonator propagative of a transverse electric mode of said discrete frequency as a consequence of physical dimensions of said resonator derived upon selection of said discrete frequency, said resonator enclosed within an electrically conductive enclosure defined as the shield, wherein said resonator is in contact with said shield by having abutment of a first face of said resonator to a surface of said shield, providing thereby for conductive heat transfer therethrough said first face between said resonator and said shield, having a cavity therethrough said resonator and having an elongated plunger movable into and out of said cavity, and also having plunger mounting means for supporting said plunger comprising an aperture through said shield, a metal tower mounted on an outside surface of said shield, said tower in juxtaposition to said shield aperture, said tower defining an enclosing volume of elongated length outside said shield and in electromagnetic communication with the interior volume of said shield, said tower enclosing volume therefore functioning as a trap for an undesired electromagnetic frequency, said tower elongated length being appropriate to trap the undesired frequency.

2. A composite filter which is a combination of "N" transverse electric mode dielectric resonating electromagnetic filters, where "N" is defined as the number of filters in the composite filter, for the selection of a discrete frequency of an electromagnetic signal which resonates in each of "N" resonators composed of dielectric material, said resonators propagative of a transverse electric mode of said discrete frequency as a consequence of physical dimensions of said resonators derived upon selection of said discrete frequency, each of said resonators enclosed within one of "N" electrically conductive enclosures defined as its shield, wherein each resonator is in contact with its shield by having abutment of a first face of said resonator to a surface of its shield, providing thereby for conductive heat transfer therethrough said first face between said resonator and its shield, wherein each shield is geometrically a section of a right circular cylinder having an angle "C" between two intersecting shield faces equal to 360 degrees divided by "N", and all "N" filters abut at the apexes of each angle "C" to form a whole right circular cylinder shaped composite filter.

3. A transverse electric mode dielectric resonating electromagnetic filter for the selection of a discrete frequency of an electromagnetic signal which resonates in a resonator composed of dielectric material, said resonator propagative of a transverse electric mode of said discrete frequency as a consequence of physical dimensions of said resonator derived upon selection of said discrete frequency, said resonator enclosed within an electrically conductive enclosure defined as the shield, wherein the improvement is that said resonator is in contact with said shield by having abutment of a first face of said resonator to a surface of said shield, providing thereby for conductive heat transfer therethrough said first face between said resonator and said shield, wherein said shield is geometrically a wedge-shaped section of a right circular cylinder.

4. A transverse electric mode dielectric resonating electromagnetic filter for the selection of a discrete frequency of an electromagnetic signal which resonates in a resonator composed of dielectric material, said resonator propagative of a transverse electric mode of said discrete frequency as a consequence of physical dimensions of said resonator derived upon selection of said discrete frequency, said resonator enclosed within an electrically conductive enclosure defined as the shield, wherein the improvement is that said resonator is in contact with said shield by having abutment of a first face of said resonator to a surface of said shield, providing thereby for conductive heat transfer therethrough said first face between said resonator and said shield wherein said shield has attached thereto an input electrical terminal for introduction to said filter of said electromagnetic signal, a first output electrical terminal for said discrete frequency, and means for attachment to said shield for an output electrical terminal, said means located at a site on said shield remote from said first output electrical terminal and from said input electrical terminal, enabling operator installation of an alternate output terminal on said shield at said remote site.

* * * * *